US012729693B2

(12) United States Patent
Peterson et al.

(10) Patent No.: US 12,729,693 B2
(45) Date of Patent: Sep. 8, 2026

(54) FAN BLADE RETENTION SYSTEM AND RELATED METHODS

(71) Applicant: DELTA T, LLC, Lexington, KY (US)

(72) Inventors: Gregory W. Peterson, Nicholasville, KY (US); Igor Davidenko, Lexington, KY (US)

(73) Assignee: DELTA T, LLC, Lexington, KY (US)

( * ) Notice: Subject to any disclaimer, the term of this patent is extended or adjusted under 35 U.S.C. 154(b) by 223 days.

(21) Appl. No.: 17/977,321

(22) Filed: Oct. 31, 2022

(65) Prior Publication Data

US 2023/0096083 A1 Mar. 30, 2023

Related U.S. Application Data

(63) Continuation of application No. 16/812,815, filed on Mar. 9, 2020, now Pat. No. 11,486,412.

(60) Provisional application No. 62/815,687, filed on Mar. 8, 2019.

(51) Int. Cl.

| | |
|---|---|
| ***F04D 29/34*** | (2006.01) |
| ***F04D 25/08*** | (2006.01) |
| ***F04D 29/32*** | (2006.01) |
| ***F04D 29/60*** | (2006.01) |

(52) U.S. Cl.

CPC ..... *F04D 29/34* (2013.01); *F04D 25/088* (2013.01); *F04D 29/329* (2013.01); *F04D 29/601* (2013.01)

(58) Field of Classification Search

CPC ..... F04D 29/34; F04D 25/088; F04D 29/329; F04D 29/601

USPC ..... 416/204 R

See application file for complete search history.

(56) References Cited

U.S. PATENT DOCUMENTS

| | | | | |
|---|---|---|---|---|
| 5,927,945 | A * | 7/1999 | Chen | F01D 5/3069 416/214 R |
| 6,059,531 | A * | 5/2000 | Tai | F04D 29/34 416/207 |
| 6,438,322 | B1 * | 8/2002 | Reiker | F04D 25/088 392/364 |
| 6,527,516 | B2 * | 3/2003 | Crevel | F04D 29/263 416/204 R |
| 6,699,014 | B1 * | 3/2004 | Lam | F04D 29/34 416/220 A |
| 9,909,590 | B1 * | 3/2018 | Nicholas | F04D 19/002 |
| 10,920,830 | B2 * | 2/2021 | Hallgren | F16D 1/097 |
| 10,935,043 | B1 * | 3/2021 | Liu | F04D 29/362 |
| 11,027,038 | B1 * | 6/2021 | Rhoades | A61L 9/22 |

(Continued)

*Primary Examiner* — Logan M Kraft
*Assistant Examiner* — John D Bailey
(74) *Attorney, Agent, or Firm* — Dickinson Wright PLLC; Andrew D. Dorisio; Nicholas P. Coleman

(57) ABSTRACT

A fan includes a motor adapted to be rotated about an axis and a hub adapted to be rotated by the motor. The hub may include first and second hub parts adapted to mate to form the hub, the first and second hub parts having a gap therebetween. A plurality of fan blades each includes an end portion located in the gap formed between the first and second hub parts, which may be drawn together by a fastener to capture the blades therebetween. One or more of the fan blades may include a receiver, such as an open-ended groove, for receiving a portion of the hub. An adapter may be configured to remain stationary during use while the hub and fan blades rotate, and a portion of the hub is adapted to be selectively deployed to engage the adapter to prevent rotation of the hub. Related methods are also disclosed.

21 Claims, 11 Drawing Sheets

(56) References Cited

U.S. PATENT DOCUMENTS 11,313,374 B2* 4/2022 Lee ..... F04D 25/088
11,486,412 B1* 11/2022 Peterson ..... F04D 25/088
11,547,050 B1* 1/2023 Hansen ..... F04D 29/644
2004/0057831 A1* 3/2004 Lin ..... F04D 29/34 416/210 R
2005/0287005 A1* 12/2005 Gruber ..... F04D 25/0613 416/244 R
2008/0193294 A1* 8/2008 Grant ..... F04D 25/088 416/204 R
2008/0286105 A1* 11/2008 Gajewski ..... F04D 29/36 416/155
2009/0004015 A1* 1/2009 Wang ..... F04D 25/088 416/210 R
2009/0155080 A1* 6/2009 Yu ..... F04D 29/34 416/212 R
2009/0208333 A1* 8/2009 Smith ..... F04D 25/088 416/61
2010/0104442 A1* 4/2010 Haynes ..... F04D 29/34 417/423.1
2011/0116932 A1* 5/2011 Poon ..... F03D 7/0224 416/205
2011/0116946 A1* 5/2011 Webb ..... F04D 29/34 416/210 R
2011/0171021 A1* 7/2011 VanOtten Tolman ..... F04D 19/024 416/128
2011/0206521 A1* 8/2011 Horng ..... F04D 29/263 416/204 R
2011/0262278 A1* 10/2011 Fizer ..... F04D 29/329 416/220 R
2012/0121406 A1* 5/2012 Wu ..... F04D 25/06 415/213.1
2012/0148408 A1* 6/2012 Gasser ..... F16D 3/20 416/131
2012/0201705 A1* 8/2012 Spaggiari ..... F04D 29/329 417/423.14
2013/0003495 A1* 1/2013 Pyddoke ..... F04D 29/34 366/343
2013/0017104 A1* 1/2013 Stewart ..... F04D 25/08 415/203
2013/0280077 A1* 10/2013 Iwamoto ..... F04D 19/002 416/204 R
2014/0072445 A1* 3/2014 Ulgen ..... F04D 29/329 416/244 B
2014/0105749 A1* 4/2014 Pellenc ..... F04D 29/023 416/223 R
2014/0356174 A1* 12/2014 Wang ..... A63H 27/001 416/204 R
2015/0300364 A1* 10/2015 Lin ..... F04D 25/088 416/221
2016/0290357 A1* 10/2016 Whitley ..... F04D 19/002
2017/0037868 A1* 2/2017 Chang ..... F04D 25/088
2017/0175773 A1* 6/2017 Mckee ..... F04D 29/34
2019/0120247 A1* 4/2019 Conley ..... F04D 29/364
2019/0145424 A1* 5/2019 Tai ..... F04D 29/388 416/220 A
2019/0264702 A1* 8/2019 Huggins ..... F04D 25/088
2019/0344105 A1* 11/2019 Rol ..... F04D 25/105
2020/0217327 A1* 7/2020 Noble ..... F04D 29/329
2020/0220426 A1* 7/2020 Horng ..... H02K 7/083
2020/0251939 A1* 8/2020 Zhang ..... F04D 25/0606
2020/0263700 A1* 8/2020 Lee ..... F21V 33/0096
2021/0062822 A1* 3/2021 Manchester ..... F04D 25/084
2025/0154959 A1* 5/2025 Tan ..... F04D 25/084

* cited by examiner

FAN BLADE RETENTION SYSTEM AND RELATED METHODS

This patent application is a continuation of U.S. application Ser. No. 16/812,815 filed on Mar. 9, 2020 and claims the benefit of U.S. Provisional patent application. Ser. No. 62/815,687, the disclosures of which are incorporated herein by reference.

TECHNICAL FIELD

This document relates generally to the fan arts and, more particularly, to a retention system for aligning and attaching a fan blade to a hub of a fan, such as for example a ceiling fan.

BACKGROUND

A fan typically includes a central hub with a plurality of blades extending radially from the hub. There are various methods for attaching blades to the hub. Most approaches rely on a linking element, such as a blade iron. However, this attachment configuration creates a weak structural link between the hub and blade.

Another shortcoming of the use of a linking element is that such is normally externally visible by a user after installation. Therefore, any fasteners used to attach the airfoil to the hub via a blade iron are also normally visible. This exposure of fasteners can cause both an unpleasant aesthetic and may also expose fasteners to environmental degradation.

Furthermore, in the case of a ceiling fan, assembly is typically completed at the installation site, as such fans are normally shipped in a partially assembled state, with at least the blades unattached to the hub. This is generally to promote ease of shipment, as a fully assembled ceiling fan would require much larger and bulkier shipping containers than a partially disassembled fan. Such assembly of blades at the point of installation may be unpleasant for the user.

Thus, a retention system for fan blades is desired that overcomes some or all of the foregoing issues, and perhaps others that have yet to be discovered.

SUMMARY

According to a first aspect of the disclosure, a fan is provided, which may be embodied in the form of a ceiling fan, but could also take any other form (including, for example, a directional fan, a pedestal fan, or the like). The fan includes a motor adapted to rotate a hub about an axis. The hub may comprise first and second hub parts adapted to mate to form the hub, the first and second hub parts having a gap therebetween. A plurality of fan blades are also provided, each of the fan blades having an end portion located in the gap formed between the first and second hub parts.

In some embodiments, one of the first and second hub parts includes a projection and the other of the first and second hub parts includes a receiver adapted for receiving the projection. In some embodiments, the end portion of the one or more blades includes at least one receiver for receiving a projection formed on one of the first and second hub parts. The at least one receiver may comprise an open-ended groove for receiving an axially extending projection from one of the first and second hub parts, which projection and groove may have substantially equal widths. The other of the first and second hub parts includes a cavity for receiving the projection when the first and second hub parts are mated.

The first and second hub parts may be annular. The first and second hub parts may each include opposing contoured or curved surfaces that match corresponding surfaces of the end portions of the plurality of blades. Each of the first and second hub parts may include axially aligned apertures and further including at least one fastener for positioning in the axially aligned apertures to connect the first and second hub parts.

The fan may also include a hub cover adapted to cover at least one of the first and second hub parts, the hub cover including a generally circumferentially extending slot for receiving the end portion of at least one fan blade. The hub cover may include at least one access opening for aligning with the axially aligned apertures of the first and second hub parts to provide access to the fastener. An adapter may be configured to remain stationary during use while the hub and plurality of fan blades rotate, and wherein the first hub part includes a projection adapted to engage the adapted to prevent rotation of the hub when the fastener is loosened while still retaining the first hub part to the second hub part, and to allow rotation when the fastener is sufficiently tightened to secure the plurality of fan blades in place.

A further aspect of the disclosure relates to a fan, comprising a motor adapted to rotate a hub about an axis. The hub comprises first and second hub parts adapted to mate, one of the first and second hub parts including a projection generally aligned with the axis. One or more fan blades are provided, which may have an end portion with a receiver adapted to receive the projection.

In some embodiments, the receiver comprises an open-ended groove extending transversely to the axis, the open-ended groove having a first width substantially equal to a second width of the projection. In some embodiments, the receiver comprises an aperture. In some embodiments, the first and second hub parts include a plurality of projections, and the one or more fan blades include a plurality of receivers, each adapted to receive at least one of the projections.

In some embodiments, the first and second hub parts include contoured or curved surfaces that match a corresponding surface of at least one of the one or more fan blades. The fan may further include an adapter configured to remain stationary during use while the hub and fan blades rotate, and wherein the first hub part includes a projection adapted to engage the adapted to prevent rotation of the second hub when separated apart but still connected and to allow rotation when the first and second hub parts are in position for securing the one or more blades in place.

A further aspect of the disclosure pertains to a fan, comprising a motor adapted to rotate a hub about an axis, and a plurality of fan blades adapted to be connected to the hub. An adapter is configured to remain stationary during use while the hub and fan blades rotate, and a portion of the hub is adapted to be selectively deployed to engage the adapter to prevent rotation of the hub.

In some embodiments, the hub comprises first and second hub parts adapted to mate to form the hub, the first and second hub parts having a gap therebetween, and each of the fan blades includes an end portion located in the gap formed between the first and second hub parts. At least one fastener is adapted for connecting the first and second hub parts together, wherein a loosened condition of the fastener corresponding to a position of the portion of the hub to prevent rotation thereof.

Also disclosed is a method of assembling a fan. The method comprises capturing an end portion of each of a plurality of fan blades between first and second parts of a hub adapted to be rotated by a motor. The method may further comprise the step of preventing rotation of the hub when the first and second parts are separated to install or remove one or more of the plurality of fan blades. The capturing step may comprise passing an end portion of at least one fan blade through a slot in a hub cover and into a gap between the first and second hub parts, and then tightening one or more fasteners to close the gap and capture the end portion between the first and second hub parts.

The end portion of each fan blade may include a groove, and the passing step comprises passing a projection on one of the first and second hub parts into the groove.

BRIEF DESCRIPTION OF THE DRAWING FIGURES

The above and further advantages according to the inventions disclosed herein may be better understood by referring to the following description in conjunction with the accompanying drawings in which.

Figure 1:
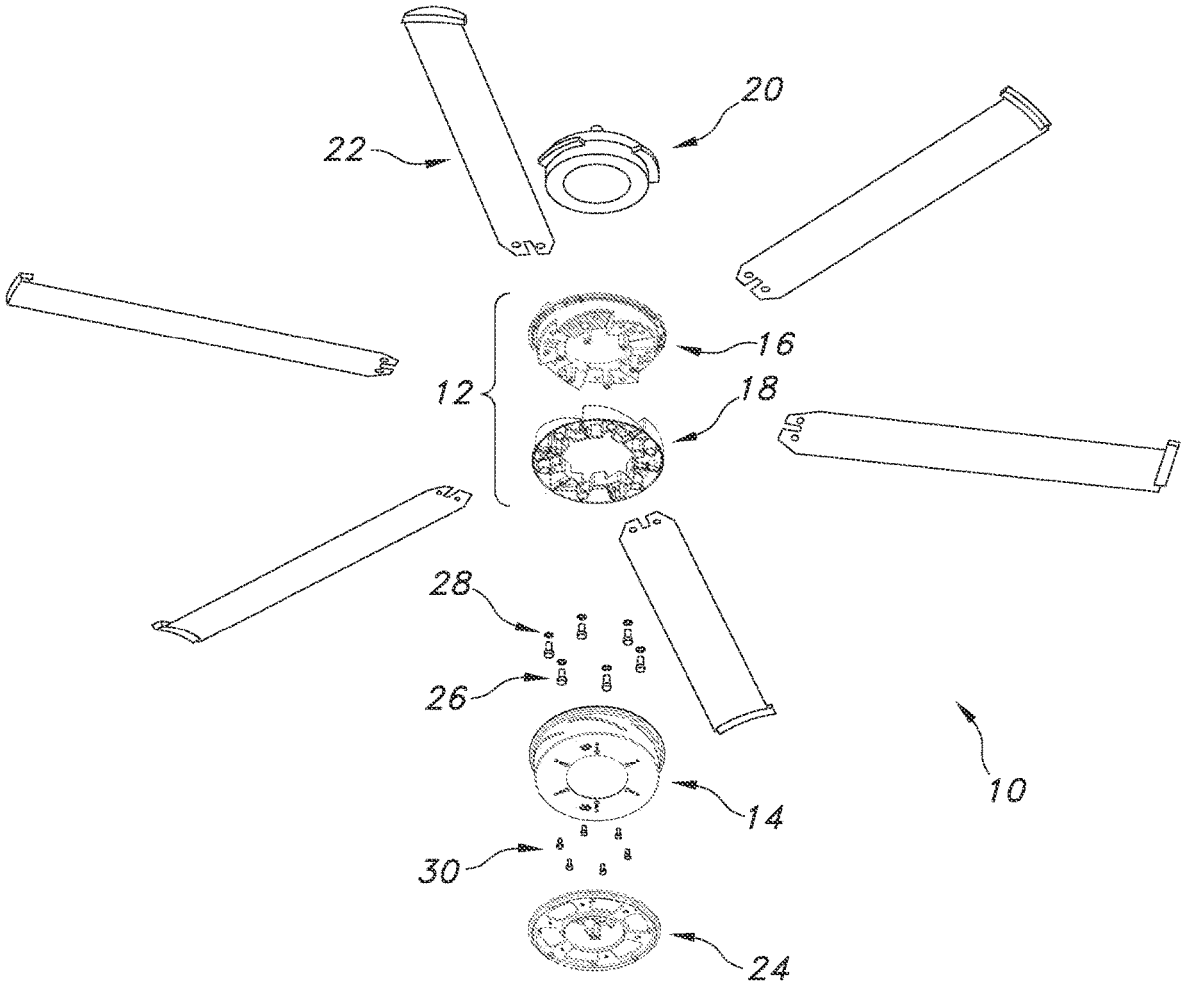
FIG. 1 is an exploded view of a fan blade retention system according to one aspect of the disclosure.

The drawings are not necessarily drawn proportionally or to scale. For example, the dimensions of some of the elements may be exaggerated relative to other elements for clarity or several physical components may be included in one functional block or element. Further, sometimes reference numerals may be repeated among the drawings to indicate corresponding or analogous elements.

DETAILED DESCRIPTION

According to a first aspect of the disclosure, a fan 10 with a blade alignment and retention system is provided. With reference to FIG. 1, an exploded view of the fan 10 is provided, which illustrates a hub 12 with a cover 14 adapted to cover a first hub part 16 adapted to engage a second hub part 18. As further outlined herein, the first hub part 16 may be an upper hub, and the second hub part 18 may be a lower hub. For the purposes of this disclosure, the first hub part 16 will be referred to as the lower hub part, and the second hub will be referred to as the upper hub part 18, although this orientation is simply for illustration purposes of a typical use when the fan comprises a suspended ceiling fan. The assembled hub parts 16, 18 are adapted to engage a motor 20, such as an electric motor including a rotor and stator, which serves to rotate the hub 12.

The fan 10 further includes a plurality of blades 22 extending radially from the hub 12. Any number of blades 22 may be provided, including three, four, five, six, eight, or more blades. Each blade 22 may have an airfoil shape, and thus may have a degree of curvature along at least one end directed away from the hub 12 that creates air disruptions upon operation of the fan 10. As will be described below, the blades 22 may be adapted to engage the hub 12, such as between the hub parts 16, 18.

Figure 2:
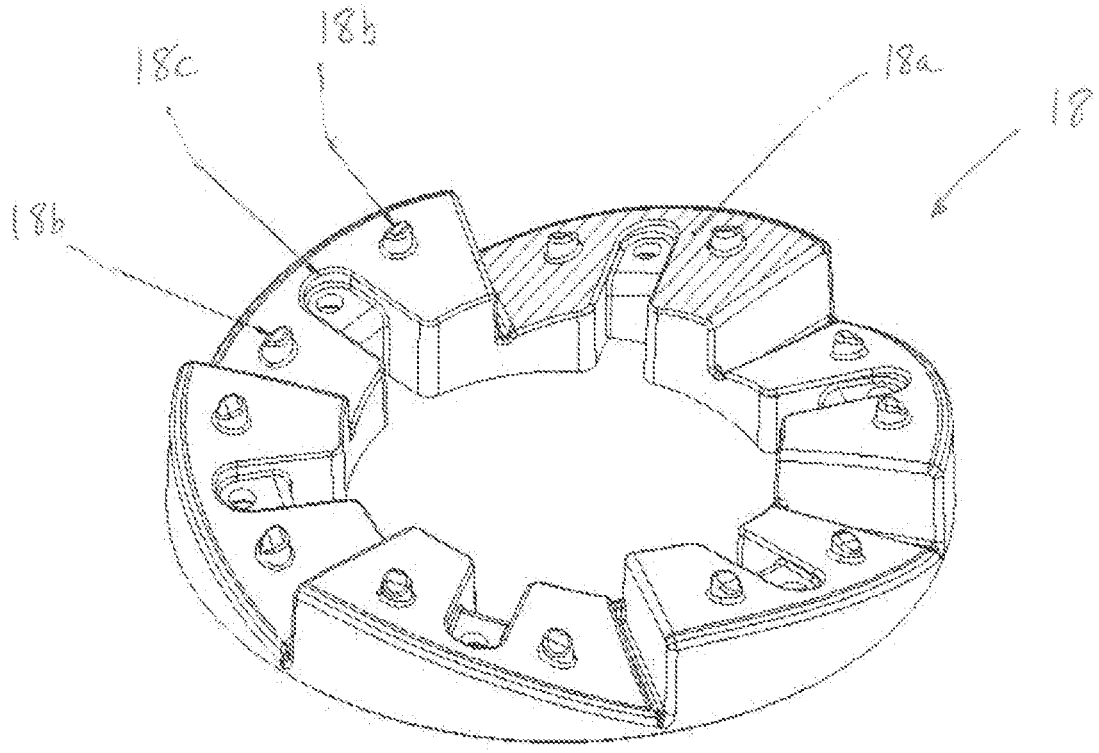
FIG. 2 is a top perspective view of an upper hub part.

With reference to FIG. 2, the lower hub part 18 is illustrated in further detail. As can be seen, the lower hub part 18 may be annular in shape, and may be stepped as illustrated (with each step corresponding to a mounting location for one fan blade 22). Each step may include one or more first hub surfaces or lower hub surfaces 18*a* for engaging a portion of the blade 22. For purposes of this disclosure, the first hub surface is referred to as the lower hub surface 18*a*. The lower hub surface 18*a* may be contoured, as shown, with a curved surface that matches a corresponding surface of the blade 22. The arrangement of the lower hub surface 18*a* may provide for an angled orientation of the blade 22 with respect to the horizontal plane upon assembly, and thus define the angle of attack. Such angled orientation allows the blade 22 to better impart air disruption when the fan 10 operates.

The lower hub part 18 may further include one or more one or more lower retention elements, such as a boss or projection 18*b*, extending generally in an axial direction for retaining a fan blade 22. The lower hub part 18 may further include a lower hub alignment feature, such as a receiver 18*c*, for receiving a portion of the upper hub part 16 to achieve proper alignment when mated.

Figure 3:
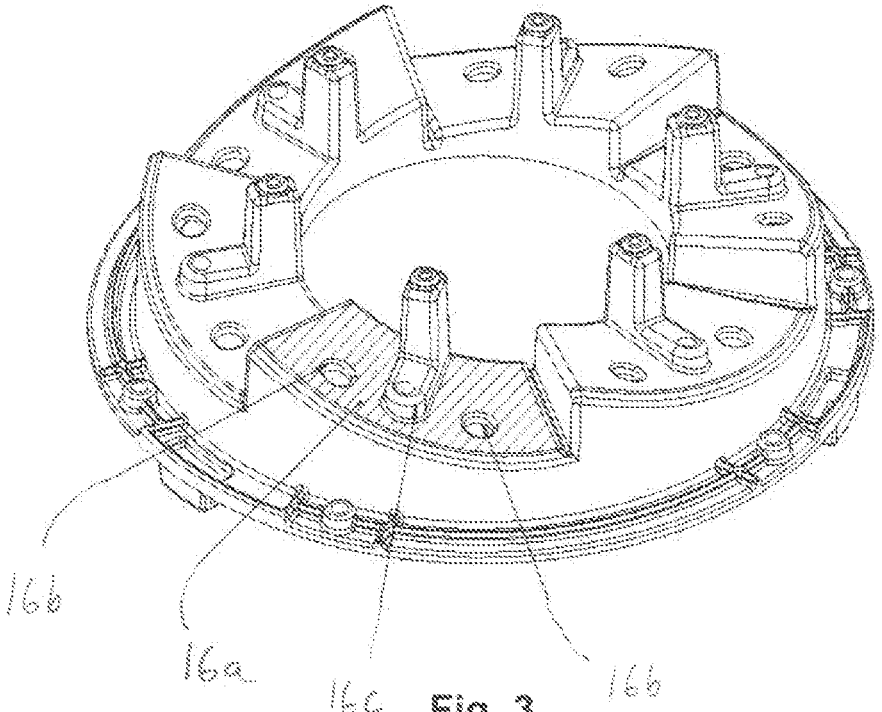
FIG. 3 is a bottom perspective view of a lower hub part.

FIG. 3 illustrates the middle hub part 16 in further detail. Middle hub part 16 may be annular in shape, and may include one or more second hub surfaces or middle hub surfaces 16*a* formed on steps corresponding to the mounting locations for the fan blades 22. For purposes of this disclosure, the second hub surface will be referred to as the middle hub surface 16*a*, and is also a contoured or curved surface so as to match a corresponding surface of the blade 22. Upon assembly of the hub parts 16, 18 to form hub 12, these upper hub surfaces 16*a* may be adapted to face the lower hub surfaces 18*a* in opposition and capture the fan blade 22 therebetween, forming a sawtooth pattern when viewed in a radial direction.

The upper hub part 16 may further include upper engagement elements, such as receivers in the form of apertures or recesses 16*b*, for cooperating with the lower retention elements, or projections 18*b*, in order to retain an associated fan blade 22. These recesses 16*b* may receive the projections 18*b* of the lower hub part 18 in order to capture the fan blade 22 upon assembly, as detailed below. The upper hub part 16 may additionally include a upper hub alignment feature, such as alignment projection 16*c*, for aligning the upper hub part 16 with the lower hub part 18. As can be seen, the alignment projection 16*c* may be adapted to be received within receiver 18*c*, thereby limiting or preventing relative movement therebetween.

Figure 4:
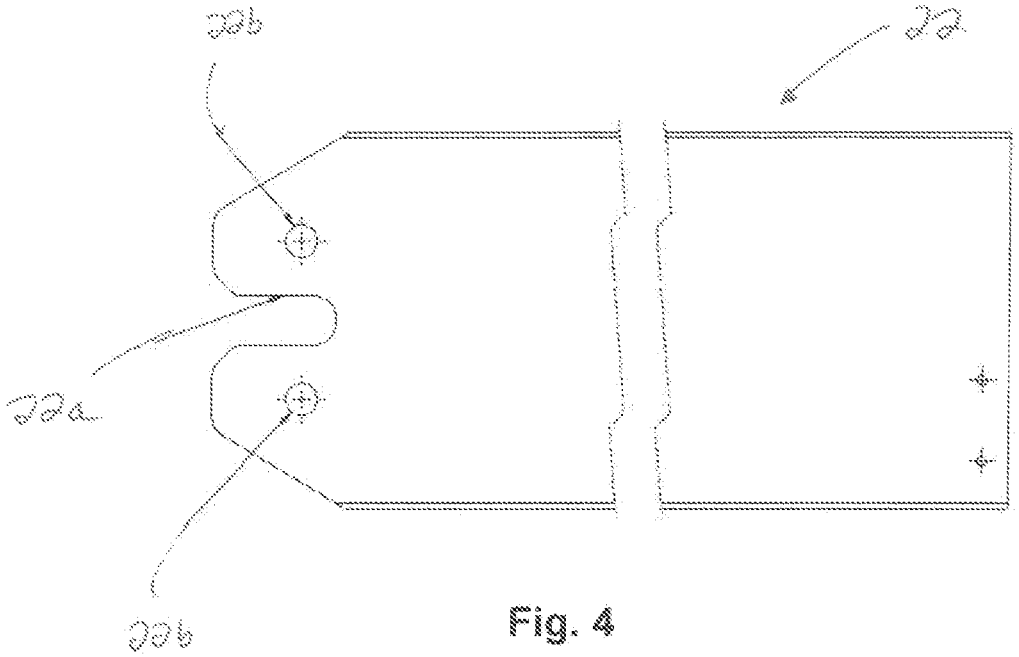
FIG. 4 is a plan view of an exemplary fan blade.

FIG. 4 illustrates a fan blade 22 that may be used with the fan 10 disclosed herein. The blade 22 may include a receiver for receiving a portion of one of the hub parts 16, 18. This receiver may comprise an open-ended groove 22*a*, which may be located at a first end of the blade 22 and has a width corresponding to the width of the projection 16*c*. This groove 22*a* may be positioned along a central longitudinal axis of the blade 22, and thus extends generally transverse to the axis of rotation of the hub 12. In one aspect, this groove 22*a* may be adapted to receive at least a portion of the alignment projection 18*b* of the lower hub part 18. This may allow for ease of assembly when the blade 22 is placed between the lower hub parts 16, 18, as the engagement of the projection 18*b* with the alignment groove 22*a* may locate the appropriate position for optimal assembly.

In another aspect, the blade 22 may include one or more guides in the form of apertures 22*b*. These apertures 22*b* may be adapted for aligning with the lower and upper engagement elements, or projections 16*c*, 18*b*, such that upon assembly, the position of the blade 22 is fixed with respect to the lower and upper hub parts 16, 18. As illustrated, the lower engagement elements in the form of projections 18*b* may be adapted to pass through the apertures 22*b*, and into the upper hub receivers 16*b*, thereby fixing the relative positions of the hub parts 16, 18, while sandwiching a first end portion of the blade 22 closest to the axis of rotation therebetween.

Figure 5:
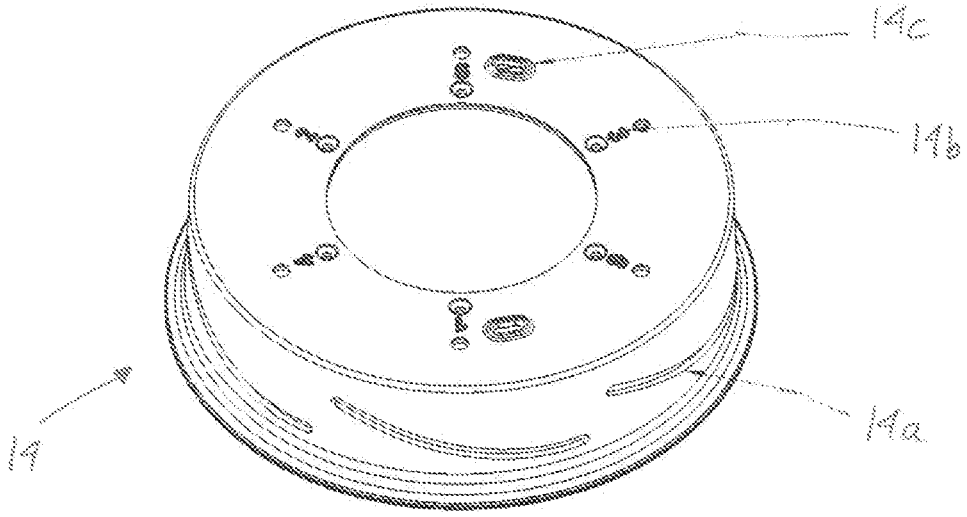
FIG. 5 is a bottom perspective view of a hub cover.

With reference to FIG. 5, the hub cover 14 includes one or more passages for receiving at least one of the blades, which may take the form of generally circumferentially extending slots 14*a*. The number of slots 14*a* may correspond to the number of blades 22. The slots 14*a* may be oriented at an angle with respect to horizontal, and may align with a gap between the lower hub surface 18*a* and the upper hub surface 16*a*, in which a portion of the blade 22 is received. This may allow for the blades 22 to be attached to the assembled hub at an angle with respect to horizontal, thereby optimally positioning the blades so as to be able to impart airflow when the hub 12 rotates.

The cover 14 may further include a pattern of access holes 14*b*. As will be explained further below, these holes 14*b* may coordinate with attachment points between the lower and upper hub parts 16, 18 to facilitate final assembly at the installation site.

Figure 6:
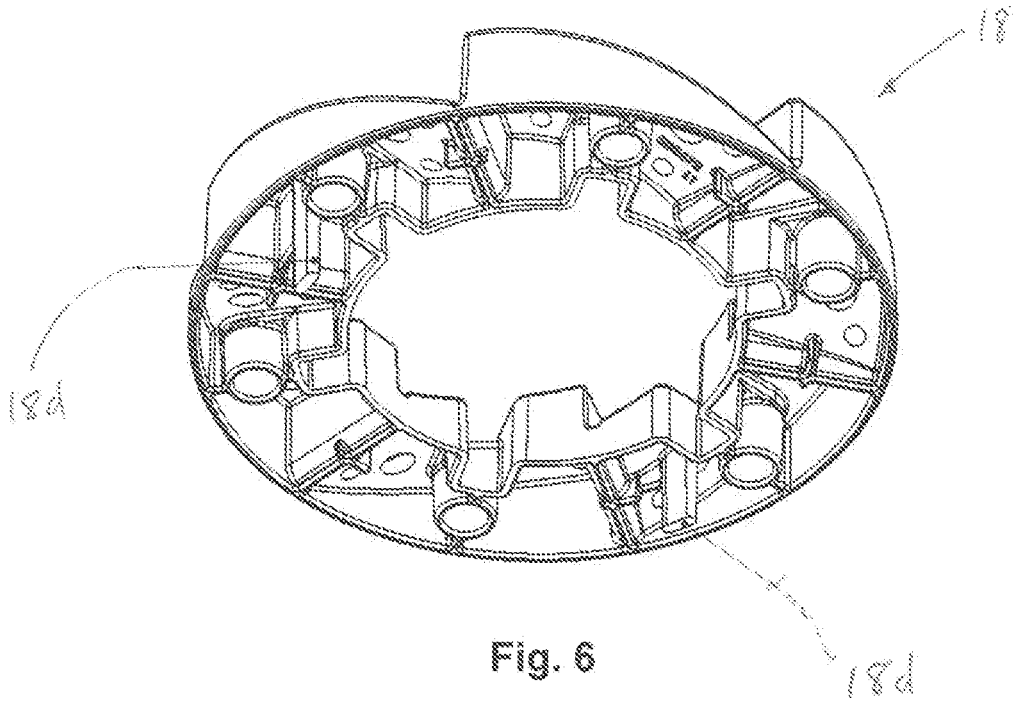
FIG. 6 is a bottom perspective view of the lower hub part.
Figure 7:
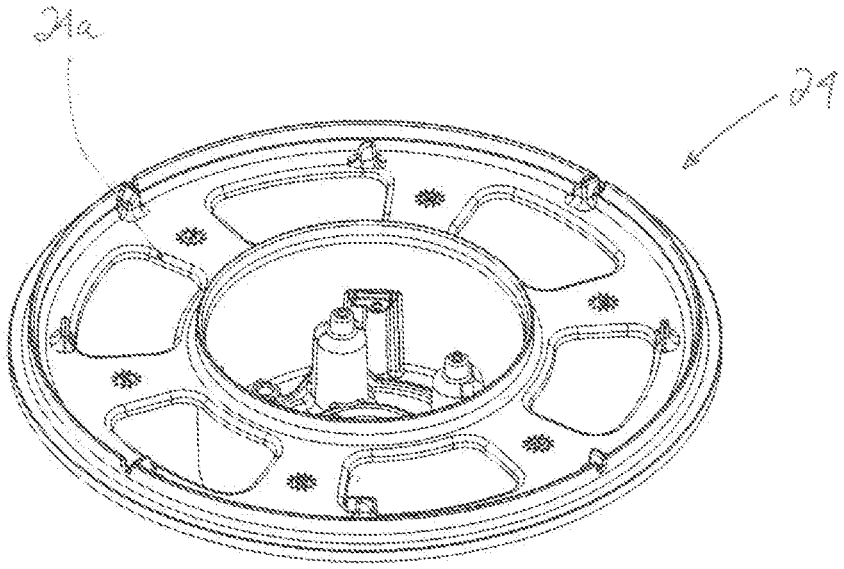
FIG. 7 is a bottom perspective view of an adapter.

One or more locking features may be provided in the hub cover 14, which may prevent rotation of the fan 10 unless proper blade attachment has occurred, as is explained below. As may best be seen in FIG. 6, a lower side of the lower hub part 18 may include one or more locking elements, such as bosses 18*d*, which may be adapted to pass through openings 14*c* of the hub cover 14. FIG. 7 illustrates an adapter 24, which may be attached to the hub cover 14 in an assembled condition, such as along a lower portion thereof, using fasteners, such as screws 30. The adapter 24 may include one or more apertures 24*a*. As explained in further detail below, the bosses 18*d* may pass through the openings 14*c* and into the apertures 24*a*, thereby preventing rotation of the hub 12 unless the blades 22 are properly attached.

Figure 8:
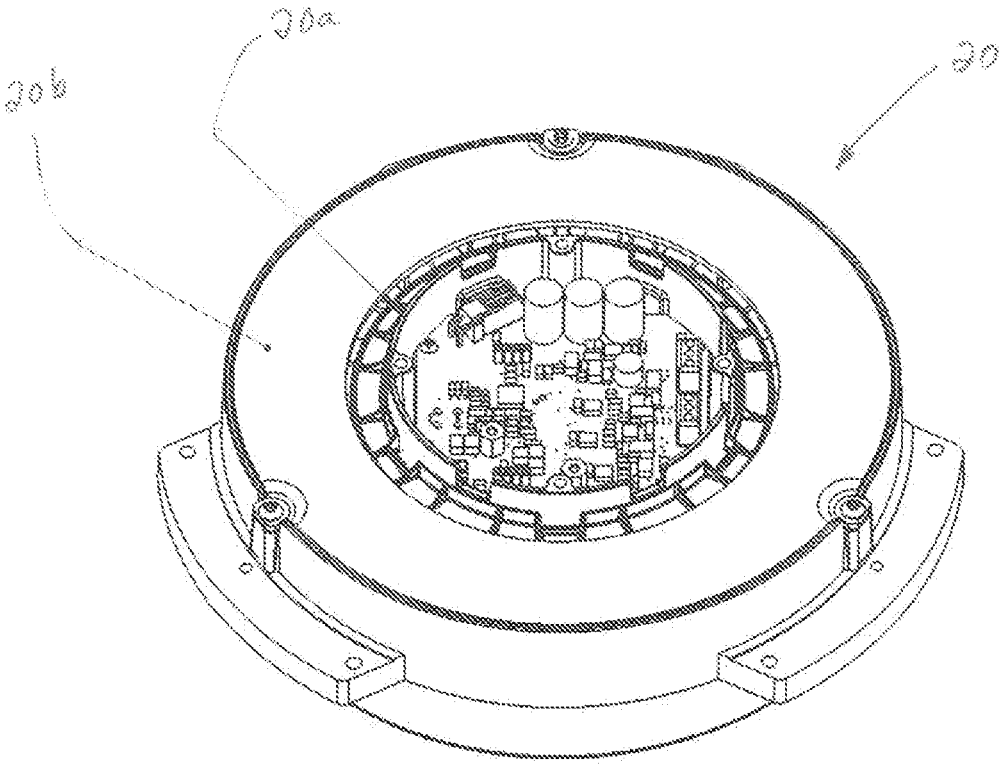
FIG. 8 is bottom perspective view of a motor.

The assembled hub 12 is connected to a motor 20, as illustrated in further detail in FIG. 8. This motor 20 may include a rotor 20*a* and a stator 20*b*, which are adapted to impart rotation to the hub 12, and therefore the blades 22.

Figure 9:
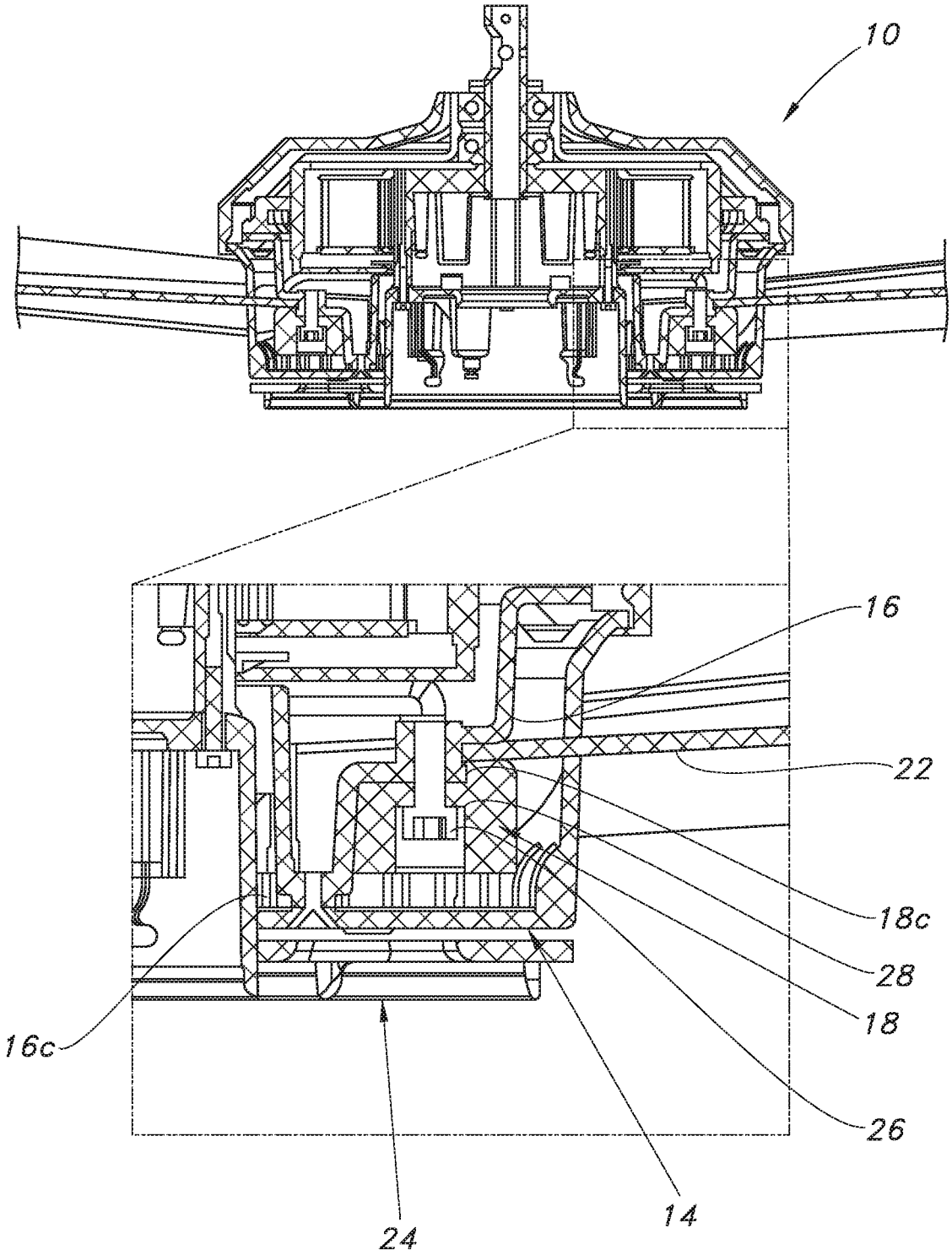
FIGS. 9, 10 and 11 are partially cutaway, partially enlarged cross-sectional views of the retention system.

FIG. 9 further illustrates a fastener system for fastening the upper and lower hub parts 16, 18 together, both prior to and during installation of the blades 22. This fastener system may allow for an initial, partial assembly of the fan 10, such as at a factory prior to arrival of the fan at the final installation site, at which time assembly may be completed. As shown, one or more fasteners, such as one or more screws 26, may be inserted through the lower hub part 18, and may be threaded into the upper hub part 16. For example, the screw 26 may pass through a threaded aperture in the lower hub part 18, such as associated with the receiver 18*c*, and into a corresponding threaded aperture in the upper hub part 16, such as associated with the projection 16*c*. One or more internal washers 28 may be provided in association with the screw 26.

The hub cover 14 may be installed onto the upper hub part 16, thereby preventing the screw 26, along with any washer (s) 28, from separating, while still allowing access to the screws 26 through the access holes 14*b*. The use of the hub cover 14 in this manner maintains the screws 26 in a relative position, such as being aligned with or at least partially threaded through at least the lower hub part 18, even if at least partially unscrewed. This allows for a more pleasant installation experience for the end user, as they do not have any chance of dropping fasteners, such as screws 26. The hub cover 14 may also protect the screws 26 and the washers 28 from environmental degradation.

Figure 10:
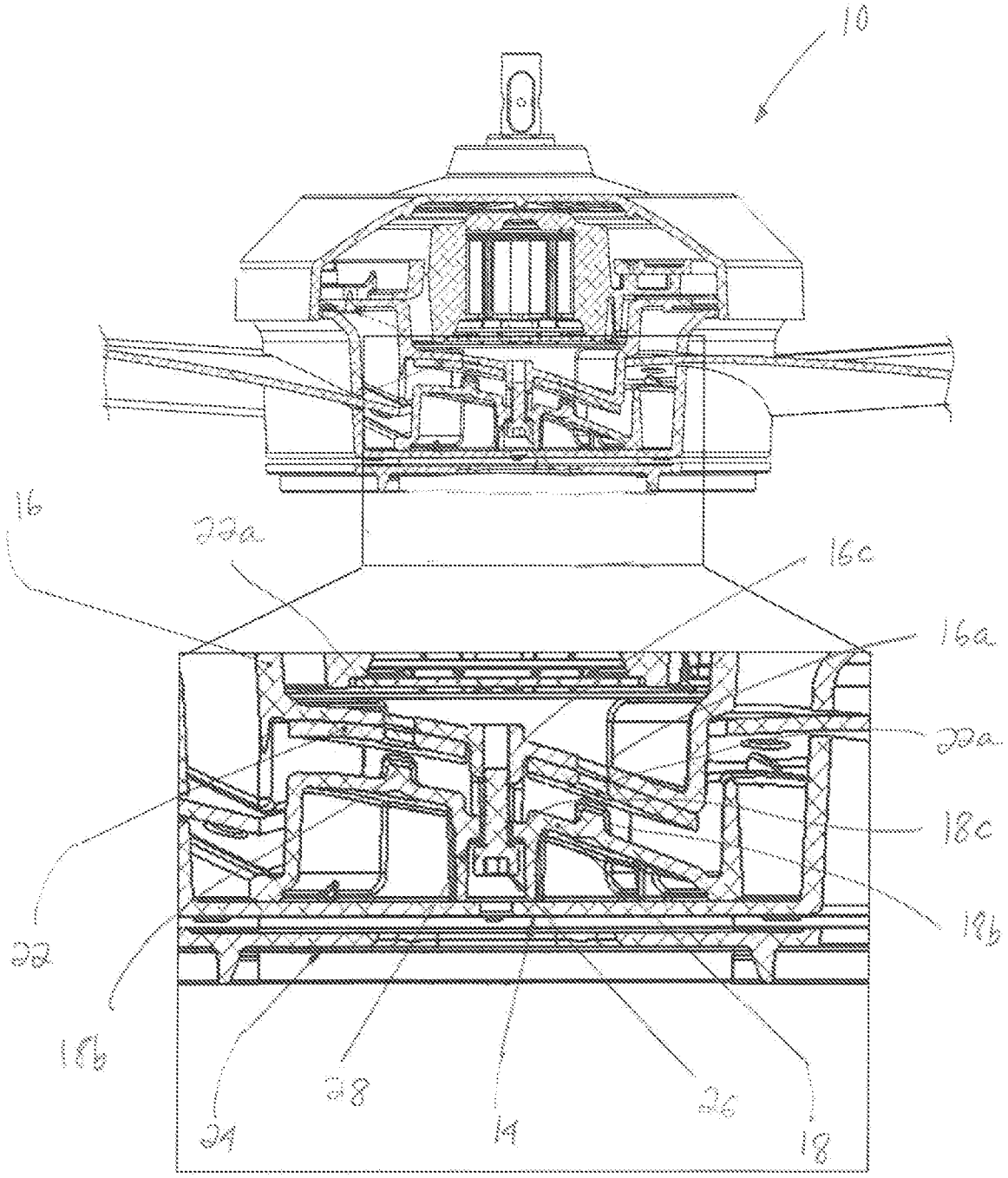
Figure 11:
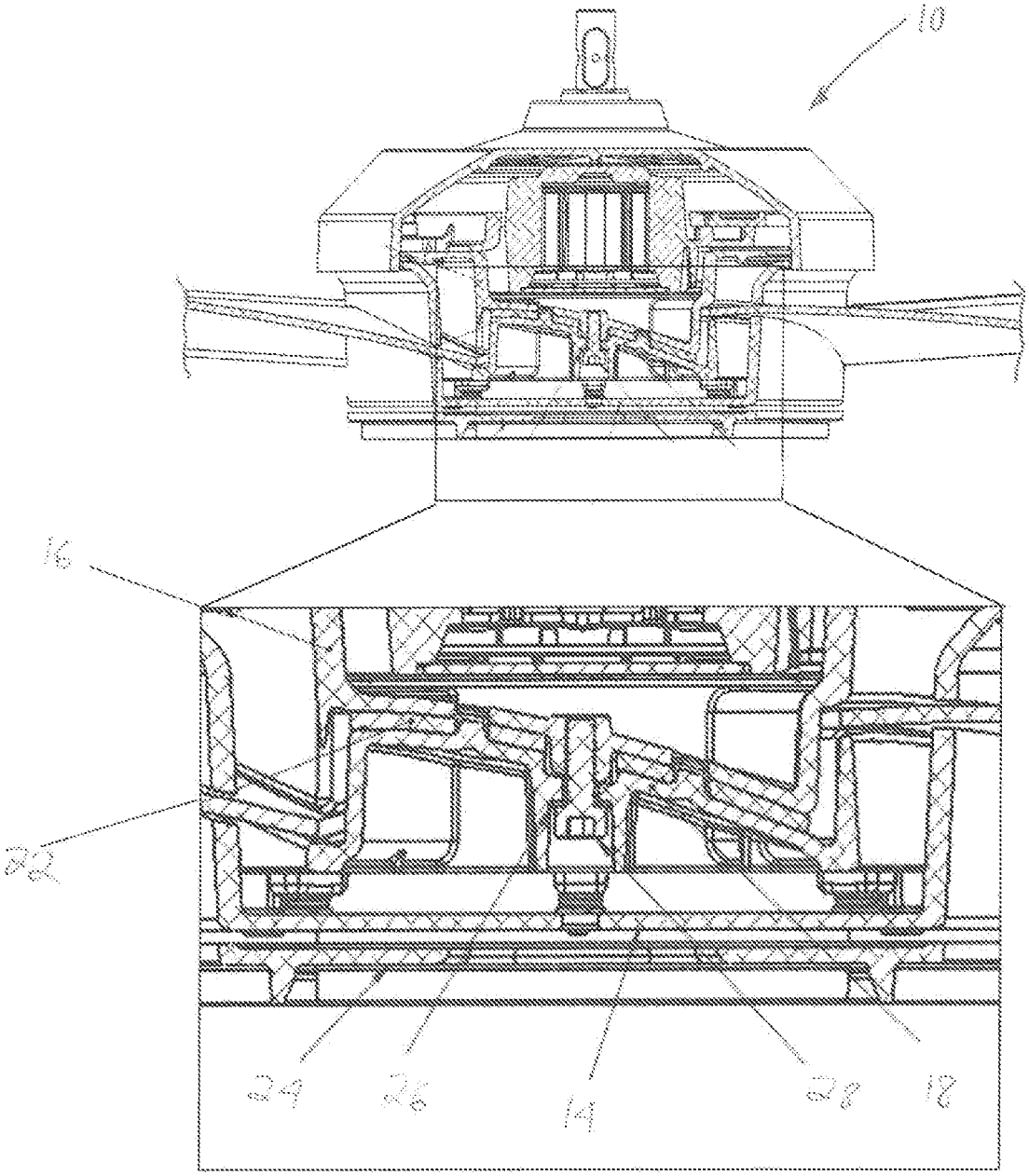

FIGS. 10 and 11 illustrate a partially cut-away, cross-sectional view of the fan 10, taken through one blade 22. FIG. 10 shows the fastener or screw 26 partially unscrewed, thereby allowing for separation of the hub parts 16, 18. This allows the placement of a portion of the blade 22 therebetween. As shown, the lower hub part 18 rests on the cover 14 in order to prevent complete separation when the fastener or screw 26 has been loosened. In this position, a blade 22 may be inserted through the slot 14*a*. The lower hub surface 18*a* and the upper hub surface 16*a* may match the profile of the corresponding portion of the blade 22, thereby creating uniform pressure on the blade 22 when fully assembled.

The alignment projection 16*c* of the upper hub part 16 may align with the receiver 18*c*, as well as the groove 22*a*, thereby locating the blade 22 in the appropriate position relative to the hub 12. The recesses 16*b* may be aligned with the coordinating bosses 18*b* of the lower hub part 18, with the bosses 18*b* being inserted into the recesses 16*b*. The screw 26 may be accessed through the lower hub cover 14, as noted above, thereby allowing for tightening the hub parts 16, 18, with the blades 22 therebetween. During this tightening, the alignment projection 16*c* and the receiver 18*c* act as a guide rail for the lower hub part 18 to travel vertically along the upper hub part 16 until assembly is complete, as shown in FIG. 11.

In another aspect, the fan 10 may include a locking system to prevent rotation if the blades 22 are not properly or fully installed, thus preventing or limiting the potential for damage due to a blade becoming dislodged from the hub 12. This locking system is illustrated with FIGS. 12 and 12A, which illustrates a fan 10 with blades 22 installed, but in which the fasteners or screws (not shown) are loose, while FIGS. 13 and 13A illustrate the fan in a properly installed condition in which the fasteners or screws (not shown) are tight, thereby appropriately retaining the fan blades 22 in place.

Figure 12:
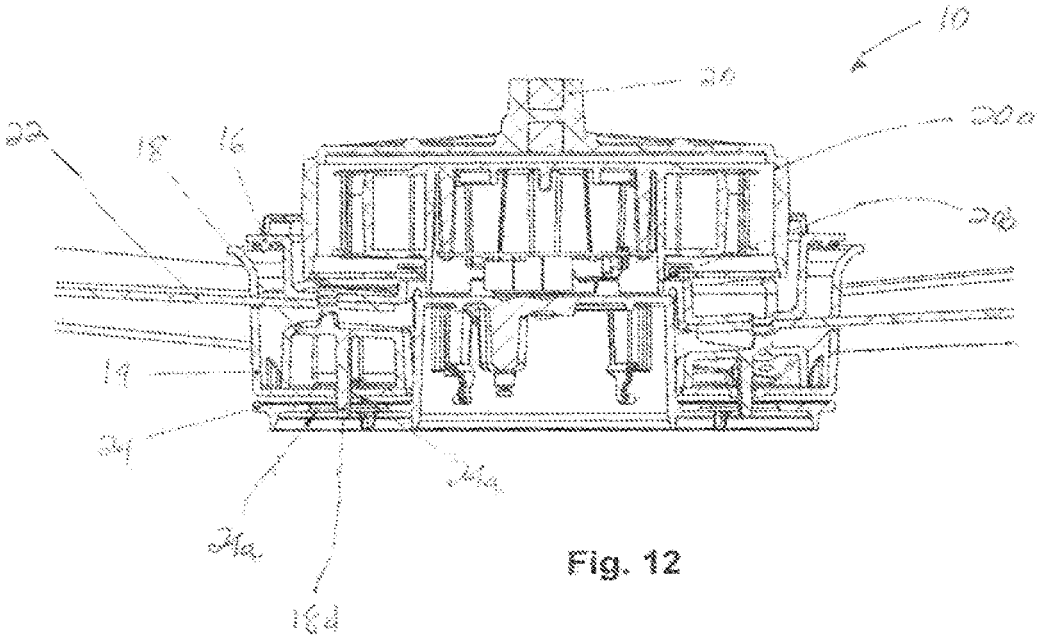
FIGS. 12 and 12A are partially cutaway, partially enlarged cross-sectional views of the retention system in a first condition.
Figure 12A:
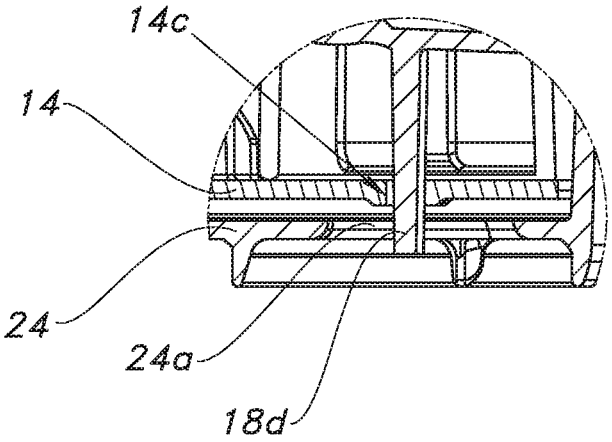

With reference to FIGS. 12 and 12A, locking elements, such as protuberances, extensions, or bosses 18*d* associated with the lower hub part 18 protrude through the openings 24*a* in the adapter 24 when the fasteners or screws 26 are not fully tightened. The adapter 24 is attached to the stator 20*b* of the motor 20 while the rest of the hub 12 and blades 22 are attached to the rotor 20*a*, so that under normal operation, the adapter 24 does not rotate, but the hub 12 and blades 22 do rotate. When the locking elements or bosses 18*d* of the lower hub part 18 extend into or through the adapter 24, as illustrated in FIGS. 12-12A, the bosses 18*d* may make contact with the opening 24*a* and prevent the fan from rotating, which prevents loose blades 22 from dropping releasing from the fan during operation.

Figure 13:
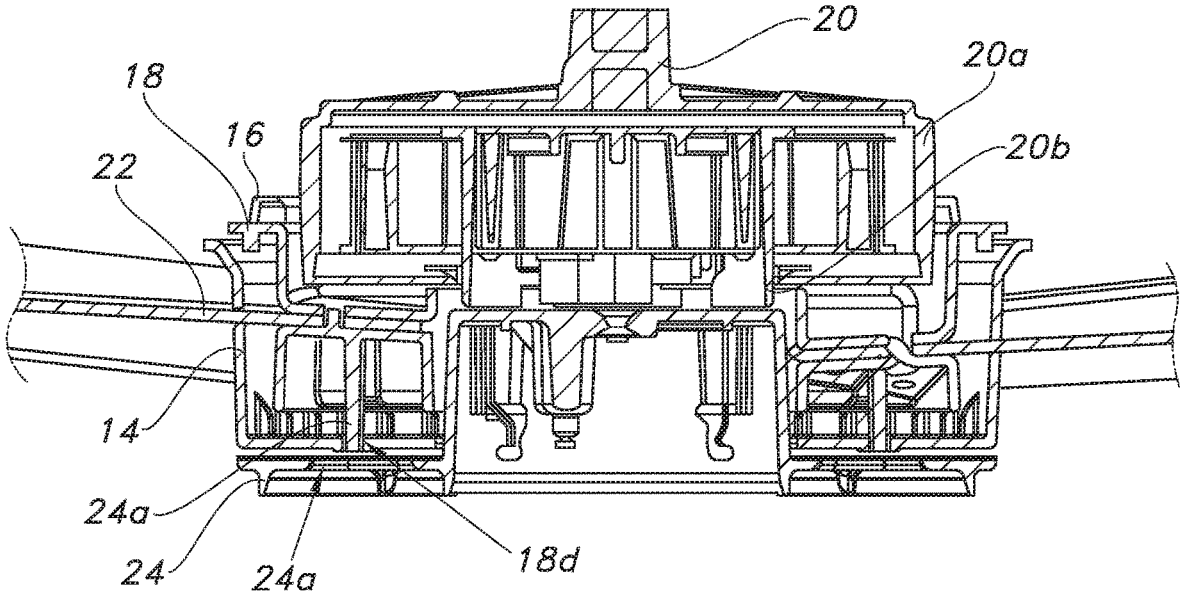
FIGS. 13 and 13A are partially cutaway, partially enlarged cross-sectional views of the retention system in a second condition.
Figure 13A:
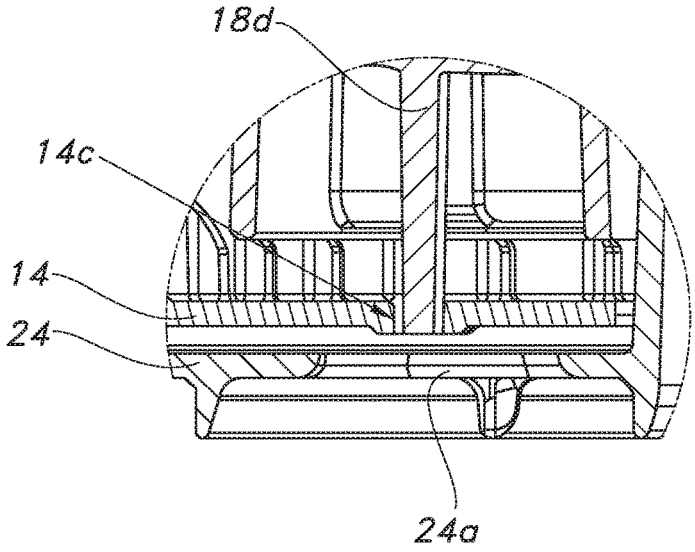

As illustrated in FIGS. 13 and 3A, once the fasteners or screws are properly tightened, thereby capturing the blades 22 between the hub parts 16, 18, the bosses 18*b* are raised to a point that they no longer extend within the adapter 24, thus allowing the fan to rotate freely. The bosses 18*b* are visible to a user underneath the fan if the bosses 18*b* extend low enough to interfere with rotation. Accordingly, if visible, the bosses 18*b* also serve as a visual verification to the user that the blades 22 have not been properly tightened. Once properly tightened, the bosses 18*b* lie flush with the openings 14*c* of the hub cover 14, and therefore the user beneath the fan can confirm whether the screws 26 have been properly tightened by visually inspecting the position of the bosses.

Figure 14:
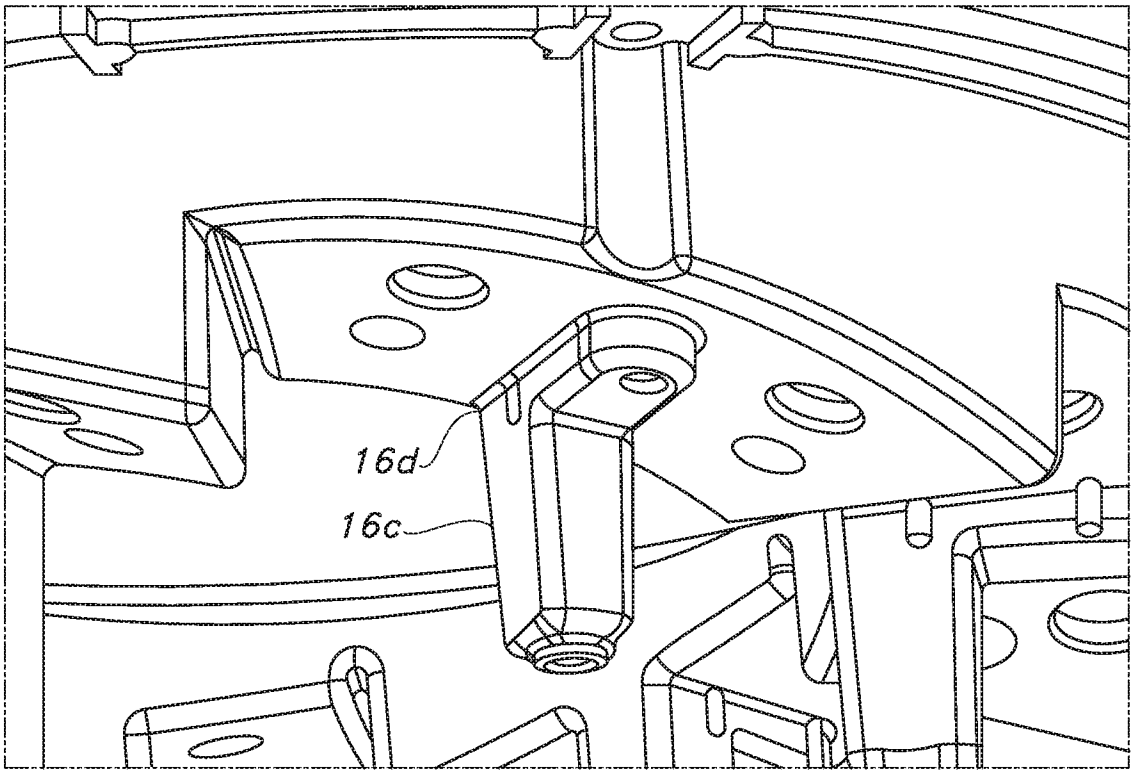
FIG. 14 is a cutaway perspective view of an alternative embodiment.

With reference to FIG. 14, it may be desirable to provide one or more ribs 16*d* on the projection 16*c* to aid in engaging the fan blades 22. For example, in the illustrated version, two axial ribs are provided on each side of the corresponding portion of the base of the projection 16*c*, which in use serve to engage the inside surfaces of the receiver or groove 22*a*.

Each of the following terms written in singular grammatical form: "a", "an", and "the," as used herein, means "at least one" or "one or more." Use of the phrase "One or more" herein does not alter this intended meaning of "a", "an", or "the." Accordingly, the terms "a", "an", and "the", as used herein, may also refer to, and encompass, a plurality of the stated entity or object, unless otherwise specifically defined or stated herein, or the context clearly dictates otherwise. For example, the phrases: "a unit", "a device", "an assembly", "a mechanism", "a component," "an element", and "a step or procedure", as used herein, may also refer to, and encompass, a plurality of units, a plurality of devices, a plurality of assemblies, a plurality of mechanisms, a plurality of components, a plurality of elements, and, a plurality of steps or procedures, respectively.

Each of the following terms: "includes", "including", "has", "having", "comprises", and "comprising", and, their linguistic/grammatical variants, derivatives, or/and conjugates, as used herein, means "including, but not limited to", and is to be taken as specifying the stated components), feature(s), characteristic(s), parameter(s), integer(s), or step(s), and does not preclude addition of one or more additional component(s), feature(s), characteristic(s), parameter(s), integer(s), step(s), or groups thereof. Each of these terms is considered equivalent in meaning to the phrase "consisting essentially of" Each of the phrases "consisting of" and "consists of, as used herein, means "including and limited to." The phrase "consisting essentially of" means that the stated entity or item (system, system unit, system sub-unit device, assembly, sub-assembly, mechanism, structure, component element or, peripheral equipment utility, accessory, or material, method or process, step or procedure, sub-step or sub-procedure), which is an entirety or part of an exemplary embodiment of the disclosed invention, or/and which is used for implementing an exemplary embodiment of the disclosed invention, may include at least one additional feature or characteristic" being a system unit system sub-unit device, assembly, sub-assembly, mechanism, structure, component or element or, peripheral equipment utility, accessory, or material, step or procedure, sub-step or sub-procedure), but only if each such additional feature or characteristic" does not materially alter the basic novel and inventive characteristics or special technical features, of the claimed item.

The term "method", as used herein, refers to steps, procedures, manners, means, or/and techniques, for accomplishing a given task including, but not limited to, those steps, procedures, manners, means, or/and techniques, either known to, or readily developed from known steps, procedures, manners, means, or/and techniques, by practitioners in the relevant field(s) of the disclosed invention.

Terms of approximation, such as the terms about, substantially, approximately, generally, etc., as used herein, refer to ±10% of a numerical value or as close as possible to a condition.

It is to be fully understood that certain aspects, characteristics, and features, of the invention, which are, for clarity, illustratively described and presented in the context or format of a plurality of separate embodiments, may also be illustratively described and presented in any suitable combination or sub-combination in the context or format of a single embodiment. Conversely, various aspects, characteristics, and features, of the invention which are illustratively described and presented in combination or sub-combination in the context or format of a single embodiment may also be illustratively described and presented in the context or format of a plurality of separate embodiments.

Although the invention has been illustratively described and presented by way of specific exemplary embodiments, and examples thereof, it is evident that many alternatives, modifications, or/and variations, thereof, will be apparent to those skilled in the art. Accordingly, it is intended that all such alternatives, modifications, or/and variations, fall within the spirit of, and are encompassed by, the broad scope of the appended claims.

The invention claimed is:

1. A fan, comprising:

a motor;

a hub adapted to be rotated about an axis by the motor, the hub comprising first and second hub parts, each of the first and second hub parts being annular in shape and defining a central aperture, the first and second hub parts being adapted to mate to form the hub, and the first and second hub parts having a gap therebetween; and a plurality of fan blades, each of the fan blades having an end portion located in the gap formed between the first and second hub parts;

wherein the end portion of each of the plurality of blades includes a blade receiver, the first hub part includes at least one alignment projection, and the second hub part includes at least one alignment receiver, and wherein the blade receiver and the alignment receiver are both adapted to receive the alignment projection when the first and second hub parts mate to form the hub.

2. The fan of claim 1, wherein the first and second hub parts each includes axially aligned apertures and further including at least one fastener for positioning in the axially aligned apertures to connect the first and second hub parts.

3. The fan of claim 2, further including a hub cover adapted to cover at least one of the first and second hub parts, the hub cover including a generally circumferentially extending slot for receiving the end portion of at least one fan blade.

4. The fan of claim 3, wherein the hub cover includes at least one access opening for aligning with the axially aligned apertures of the first and second hub parts to provide access to the fastener.

5. The fan of claim 4, further including an adapter configured to remain stationary during use while the hub and plurality of fan blades rotate, and wherein the first hub part includes a projection adapted to engage the adapter to prevent rotation of the hub when the fastener is loosened while still retaining the first hub part to the second hub part, and to allow rotation when the fastener is sufficiently tightened to secure the plurality of fan blades in place.

6. The fan of claim 1, wherein the blade receiver comprises an open-ended groove for receiving the alignment projection, and wherein the alignment projection is an axially extending projection.

7. The fan of claim 1, wherein the first and second hub parts each include opposing contoured or curved surfaces that match corresponding surfaces of the end portions of the plurality of blades.

8. The fan of claim 1, wherein the first hub part includes a first surface facing the second hub part, and the second hub part includes a second surface facing the first hub part;

wherein the first surface includes a first projection and a first receiver, and wherein the second surface includes a second projection and a second receiver;

wherein the first projection mates with the second receiver and wherein the second projection mates with the first receiver.

9. The fan of claim 1, where the first hub part includes a projection that mates with both a recess in the second hub part and further mates with a groove in at least one of the plurality of fan blades.

10. A fan, comprising:

a motor;

a hub adapted to be rotated about an axis by the motor, the hub comprising first and second hub parts adapted to mate, each of the first and second hub parts being annular in shape and defining a central aperture, the first hub part including an alignment projection generally aligned with the axis, and the second hub part including an alignment receiver adapted to mate with the alignment projection to limit relative movement between the first and second hub parts; and a plurality of fan blades, at least one of the plurality of fan blades having an end portion with a blade receiver adapted to receive the alignment projection.

11. The fan of claim 10, wherein the blade receiver comprises an open-ended groove extending transversely to the axis, the open-ended groove having a first width substantially equal to a second width of the alignment projection.

12. The fan of claim 10, wherein the alignment projection and the alignment receiver each comprises an aperture adapted to receive a fastener adapted to fasten the first and second hub parts together.

13. The fan of claim 10, wherein the second hub part includes a plurality of second projections, the plurality of fan blades each include a plurality of second blade receivers, and the first hub part includes a plurality of second receivers; and wherein each of the second blade receivers and the second receivers of the first hub part are adapted to receive at least one of the second projections of the second hub part.

14. The fan of claim 10, wherein the first and second hub parts include contoured or curved surfaces that match a corresponding surface of at least one of the one or more fan blades.

15. The fan of claim 10, further including an adapter configured to remain stationary during use while the hub and fan blades rotate, and wherein the first hub part includes a projection adapted to engage the adapter to prevent rotation of the second hub when separated apart but still connected and to allow rotation when the first and second hub parts are in position for securing the one or more blades in place.

16. A fan, comprising:

a motor;

a hub adapted to be rotated about an axis by the motor, the hub comprising first and second hub parts, each of the first and second hub parts being annular in shape and defining a central aperture;

a plurality of fan blades adapted to be connected to the hub; and an adapter configured to remain stationary during use while the hub and fan blades rotate, wherein one of the first and second hub parts is adapted to be selectively deployed to engage the adapter to prevent rotation of the hub;

wherein each of the fan blades includes an end portion located in a gap formed between the first and second hub parts, each end portion includes a blade receiver, the first hub part includes at least one alignment projection, and the second hub part includes at least one alignment receiver; and wherein the blade receiver and the alignment receiver are both adapted to receive the alignment projection when the first and second hub part are mated to form the hub, so as to limit movement of the blade with respect to the hub.

17. The fan of claim 16, further including at least one fastener adapted for connecting the first and second hub parts together, wherein a loosened condition of the fastener corresponding to a position of the portion of the hub to prevent rotation thereof.

18. A method of assembling a fan, comprising:

providing first and second annular parts of a hub, each defining a central aperture, the first and second annular parts of the hub adapted to be rotated by a motor, the first part of the hub including at least one alignment projection and the second part of the hub including at least one alignment receiver;

providing a plurality of fan blades, each of the plurality of fan blades including an end portion with a blade receiver; and capturing the end portion of each of the plurality of fan blades between the first and second annular parts of a hub such that the blade receiver of at least one of the plurality of fan blades and the at least one alignment receiver both receive the at least one alignment projection so as to limit relative movement between the first and second annular parts of the hub and the at least one of the plurality of fan blades.

19. The method of claim 18, wherein the capturing step comprises passing an end portion of at least one fan blade through a slot in a hub cover and into a gap between the first and second annular parts, and then tightening one or more fasteners to close the gap and capture the end portion between the first and second annular parts.

20. The method of claim 19, wherein the blade receiver of each fan blade includes a groove, and the passing step comprises passing the alignment projection into the groove.

21. The method of claim 18, further including the step of preventing rotation of the hub when the first and second annular parts are separated to install or remove one or more of the plurality of fan blades.

* * * * *